US010092048B2

(12) United States Patent
Yamada et al.

(10) Patent No.: US 10,092,048 B2
(45) Date of Patent: Oct. 9, 2018

(54) GARMENT

(75) Inventors: Takato Yamada, Kyoto (JP); Yuka Kitagawa, Kyoto (JP)

(73) Assignee: WACOAL CORPORATION, Kyoto-shi, Kyoto (JP)

( * ) Notice: Subject to any disclaimer, the term of this patent is extended or adjusted under 35 U.S.C. 154(b) by 0 days.

(21) Appl. No.: 14/110,342

(22) PCT Filed: Apr. 13, 2011

(86) PCT No.: PCT/JP2011/059199
§ 371 (c)(1),
(2), (4) Date: Oct. 7, 2013

(87) PCT Pub. No.: WO2012/140754
PCT Pub. Date: Oct. 18, 2012

(65) Prior Publication Data
US 2014/0020149 A1 Jan. 23, 2014

(51) Int. Cl.
*A41D 27/00* (2006.01)
*A41D 13/00* (2006.01)

(52) U.S. Cl.
CPC ..... *A41D 27/00* (2013.01); *A41D 13/0015* (2013.01); *A41D 2400/38* (2013.01)

(58) Field of Classification Search
CPC ..... A41B 9/08; A41B 2300/22; A41B 3/02; A41B 9/04
See application file for complete search history.

(56) References Cited

U.S. PATENT DOCUMENTS

2008/0000008 A1* 1/2008 Nagao ..... A41D 19/015 2/159
2008/0010725 A1* 1/2008 Yoo ..... A41B 9/02 2/401
2008/0034468 A1* 2/2008 Kleinert ..... 2/159
(Continued)

FOREIGN PATENT DOCUMENTS

CN 1108118 C 5/2003
CN 1846549 A 10/2006
(Continued)

OTHER PUBLICATIONS

International Preliminary Report on Patentability, International Application No. PCT/JP2011/059199, dated Oct. 24. 2013.
(Continued)

*Primary Examiner* — Sally Haden
(74) *Attorney, Agent, or Firm* — Leydig Voit & Mayer

(57) ABSTRACT

The present invention embodies a garment which can smoothen motions of its wearer by a new technique, which is totally different from that of exerting a tightening force on a muscle, according to findings that the range of motion of a joint can be widened if a structure for extending and gathering respective parts of a skin gathering and leaving when the joint works in relation to bending/extension or abduction/adduction of the wearer is added to the garment and that the range of motion of the joint can be widened if a structure for moving the skin along a direction of motion of a muscle when the joint works in relation to turning of the wearer is added to the garment, on the basis of a close relationship between a motion of the skin when the joint works and an extending direction of a tension line.

3 Claims, 13 Drawing Sheets

(56) References Cited

U.S. PATENT DOCUMENTS

| | | | | |
|---|---|---|---|---|
| 2008/0256675 | A1* | 10/2008 | Di Lorenzo | A41D 7/00 2/67 |
| 2008/0295216 | A1* | 12/2008 | Nordstrom | A41D 13/0015 2/69 |
| 2010/0107299 | A1* | 5/2010 | Ota et al. | 2/69 |
| 2011/0214216 | A1* | 9/2011 | Zarabi | A41D 27/02 2/69 |
| 2012/0150085 | A1* | 6/2012 | Kayser | A61F 5/026 602/19 |

FOREIGN PATENT DOCUMENTS

| | | | |
|---|---|---|---|
| CN | 101653296 | A | 2/2010 |
| JP | 8-60405 | A | 3/1996 |
| JP | 9-250008 | A | 9/1997 |
| JP | 2004-044070 | A | 2/2004 |
| JP | 2006-118088 | A | 5/2006 |
| JP | 2008-106404 | A | 5/2008 |
| JP | 2009-299239 | A | 12/2009 |
| JP | 2010-070871 | A | 4/2010 |

OTHER PUBLICATIONS

International Search Report, International Application No. PCT/JP2011/059199 dated May 17, 2011.
Office Action, Counterpart Chinese Application No. 201180070065.8, dated Jun. 3, 2014.
Office Action, Japanese Application No. P2013-509705 dated Jul. 22, 2014.

* cited by examiner

GARMENT

TECHNICAL FIELD

The present invention relates to a garment equipped with such a function as to allow joints of its wearer to widen ranges of motions and smoothen motions.

BACKGROUND ART

An example of techniques relating to this kind of field is an undershirt described in Patent Literature 1. This conventional undershirt uses three kinds of materials having different tightening forces, in which the material having the highest tightening force is put on at least a part of triceps brachii muscles, the material having the lowest tightening force is put on at least a part of trapezius, latissimus dorsi, and deltoid muscles about shoulder blades, and the material having the middle tightening force is put on the remaining part. On the other hand, for example, a shirt described in Patent Literature 2 uses a material having elasticity only in one direction and arranges the material such that the expanding/contracting direction varies among upper and lower parts of the back body, the front body, upper arm parts, sides to elbow parts, and sleeve parts.

CITATION LIST

Patent Literature

Patent Literature 1: Japanese Patent Application Laid-Open No. 2004-044070

Patent Literature 2: Japanese Patent Application Laid-Open No. 2009-299239

SUMMARY OF INVENTION

Technical Problem

Conventional garments such as those mentioned above aim mainly at stabilizing joints and muscles when the wearer moves and keeping movements from being disturbed. This is meaningful in terms of supporting motions of the wearer, but further contrivances seem to be necessary for providing a function to smoothen the motions of the wearer. If a new technique allows the wearer to widen ranges of motions of joints or induces the wearer to smoothen the motions, the athletic ability of the wearer can be improved in various kinds of sports such as tennis, golf, baseball, and running.

For solving the problem mentioned above, it is an object of the present invention to provide a garment provided with such a function as to widen ranges of motions of joints and smoothen the motions.

Solution to Problem

For achieving the above-mentioned object, in the process of conducting diligent studies, the inventors have focused attention on the fact that motions of a human body are closely related not only to bones and muscles, but also to characteristics of the skin covering their surfaces. Here, FIGS. 12 and 13 are diagrams illustrating examples of original movements of the skin accompanying motions of joints of the human body (see FUKUI Tsutomu, *Skin Kinematics*, Miwa-Shoten Ltd.). When a knee joint bends, for example, the skin on the front side of a knee gathers at the knee joint while the skin on the rear side of the knee leaves the knee joint as illustrated in FIG. 12(*a*). When the knee joint extends, for example, the skin on the front side of the knee leaves the knee joint while the skin on the rear side of the knee gathers at the knee joint, contrary to what occurring upon bending, as illustrated in FIG. 12(*b*). When a hip joint turns outward, for example, the skin extends from an inner lower part of a thigh to an outer upper part thereof as illustrated in FIG. 13(*a*); when the hip joint turns inward, for example, the skin extends from the outer upper part of the thigh to the inner lower part thereof as illustrated in FIG. 13(*b*).

Unlike such original skin movements, if the skin gathers to wrinkle or leaves a joint of a human body to stretch when the joint works, the range of motion of the joint may become narrower or the motion may be inhibited. Hence, the inventors have found that motions of a wearer can be smoothened by a new technique, which is totally different from that of exerting a tightening force on a muscle, if a structure for supporting movements of the skin in view of the original skin movements mentioned above is added to the garment, thereby completing the present invention.

The garment in accordance with one aspect of the present invention comprises a main part formed by a material having such elasticity as to fit a wearer's body tightly and an arch-shaped line part having a stretching force greater than that of the main part and exhibiting a greater radius of curvature when worn than therebefore; wherein a direction from a mountain side of the arch to a valley side thereof in the line part intersects a direction of a skin tension line when a joint works in relation to bending/extension or abduction/adduction of the wearer.

By the stretching force of the arch-shaped line part having a greater radius of curvature when worn than therebefore, this garment can move the skin of the wearer in the direction from the mountain side of the line part to the valley side thereof. The direction from the mountain side to valley side of the arch in the line part is configured so as to intersect the direction of the skin tension line when a joint works in relation to bending/extension or abduction/adduction of the wearer in this garment. The skin at a location where a wrinkle is formed by a motion of a joint tends to leave the joint. This movement is in the same direction as with an original skin movement and will restrict the motion range or the movement of the joint if insufficient. Therefore, providing the above-mentioned line part can impel the skin to move in the direction of the original skin movement. On the other hand, the skin at a location extended by a motion of a joint tends to gather at the joint. This movement is in the same direction as with an original skin movement and will restrict the motion range or the movement of the joint if insufficient. Therefore, providing the above-mentioned line part can impel the skin to move in the direction of the original skin movement. The foregoing makes it possible for this garment to widen ranges of motions of joints and smoothen the motions.

The garment in accordance with another aspect of the present invention comprises a main part formed by a material having such elasticity as to fit a wearer's body tightly and an arch-shaped line part having a stretching force greater than that of the main part and exhibiting a greater radius of curvature when worn than therebefore; wherein a direction from a mountain side of the arch to a valley side thereof in the line part extends along a direction of a skin tension line when a joint works in relation to turning of the wearer.

By the stretching force of the arch-shaped line part having a greater radius of curvature when worn than therebefore, this garment can move the skin of the wearer in the direction from the mountain side of the line part to the valley side thereof. The direction from the mountain side to valley side of the arch in the line part is configured so as to extend along the direction of a skin tension line when a joint works in relation to turning of the wearer. The skin tends to move along the tension line when the joint works in relation to turning. This movement is in the same direction as with an original skin movement and will restrict the motion range or the movement of the joint if insufficient. Therefore, providing the above-mentioned line part can impel the skin to move in the direction of the original skin movement. The foregoing makes it possible for this garment to widen ranges of motions of joints and smoothen the motions.

Here, the skin tension line is a line indicating a direction in which an internal tissue such as a muscle and the skin are hard to shift from each other when a joint works. In a human body, the tension line extends in a direction intersecting the direction of the movement of the skin for a location subjected to bending/extension or abduction/adduction and a direction along which the skin moves for a location subjected to turning.

Preferably, the line part is arranged so as to correspond to a location where a muscle of the wearer bulges upon moving. This makes the radius of curvature of the line part further greater at the time of moving, thereby allowing the line part to act on the skin more reliably.

The line part may have a greater stretching force on the valley side of the arch than the mountain side thereof. A plurality of line parts may be disposed along the direction from the mountain side of the arch to the valley side thereof, the line part located on the valley side having a stretching force greater than that of the line part located on the mountain side. Such a structure allows the line part to act on the skin more reliably.

Advantageous Effects of Invention

The garment in accordance with the present invention can widen ranges of motions of joints and smoothen the motions. As a result, the athletic ability of the wearer can be improved.

DESCRIPTION OF EMBODIMENTS

In the following, preferred embodiments of the garment in accordance with the present invention will be explained in detail with reference to the drawings.

First, findings discovered by the inventors will be explained before the embodiments. In the process of conducting diligent studies, the inventors have found that moving the skin can bring a change to motions of a human body and taken notice of a skin tension line as a rule for moving the skin.

Then, based on a close relationship between a movement of the skin when a joint works and a direction in which the tension line extends, the inventors have focused attention on the fact that the skin at a location where a wrinkle is formed by a motion of a joint in relation to bending/extension or abduction/adduction of the wearer tends to leave the joint, while the skin at a location to extend tends to gather at the joint. The inventors have found that each of these movements is in the same direction as with an original skin movement and that adding a structure for promoting these movements to the garment can widen the range of motion of the joint and smoothen the motion. The inventors have also taken notice of the fact that the skin tends to move along the tension line when the joint works in relation to turning of the wearer. The inventors have found that this movement is in the same direction as with an original movement of the skin and that adding a structure for promoting this movement to the garment can widen the range of motion of the joint and smoothen the motion.

The following embodiments embody a garment which can smoothen motions of the wearer by a new technique which is based on the foregoing findings and totally different from that of exerting a tightening force on a muscle. Here, the skin tension line is a line indicating a direction in which an internal tissue such as a muscle and the skin are hard to shift from each other when a joint works. In a human body, the tension line extends in a direction intersecting the direction of the movement of the skin for a location subjected to bending/extension or abduction/adduction and a direction along which the skin moves for a location subjected to turning.

First Embodiment

Figure 1:
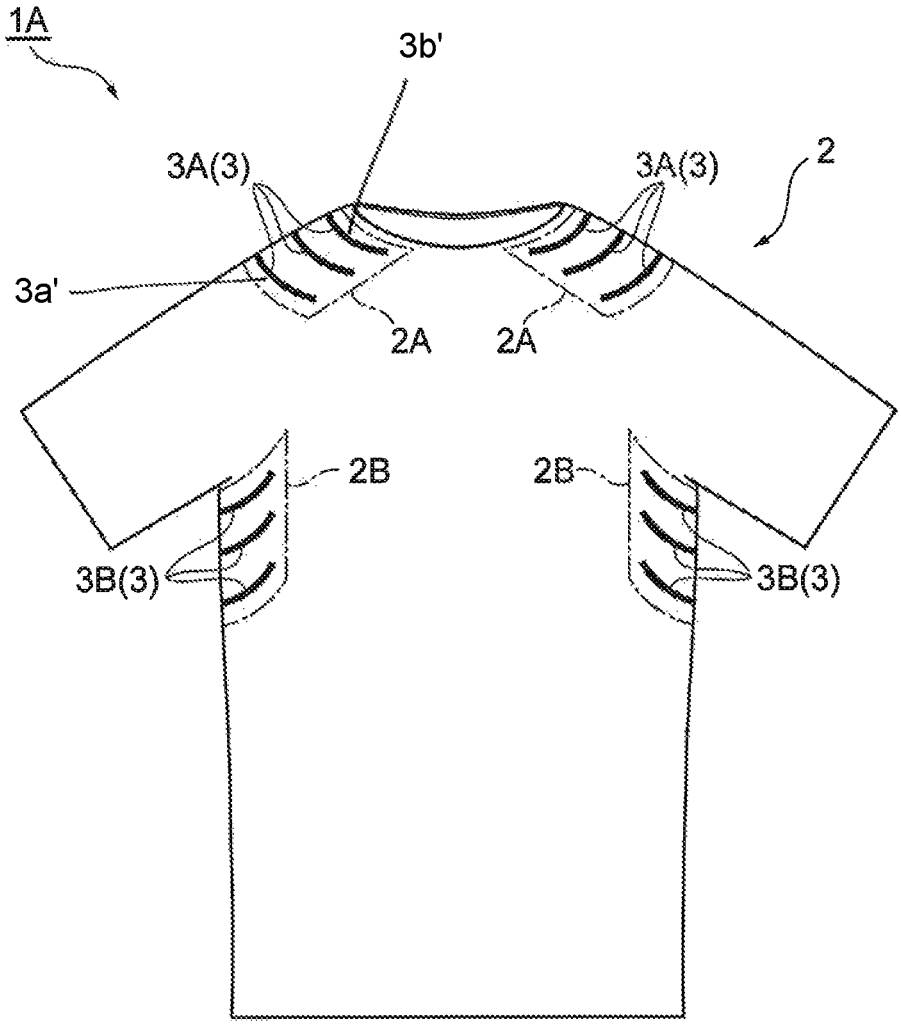
FIG. 1 is a front view illustrating an undershirt which is a first embodiment of the garment in accordance with the present invention.
Figure 2:
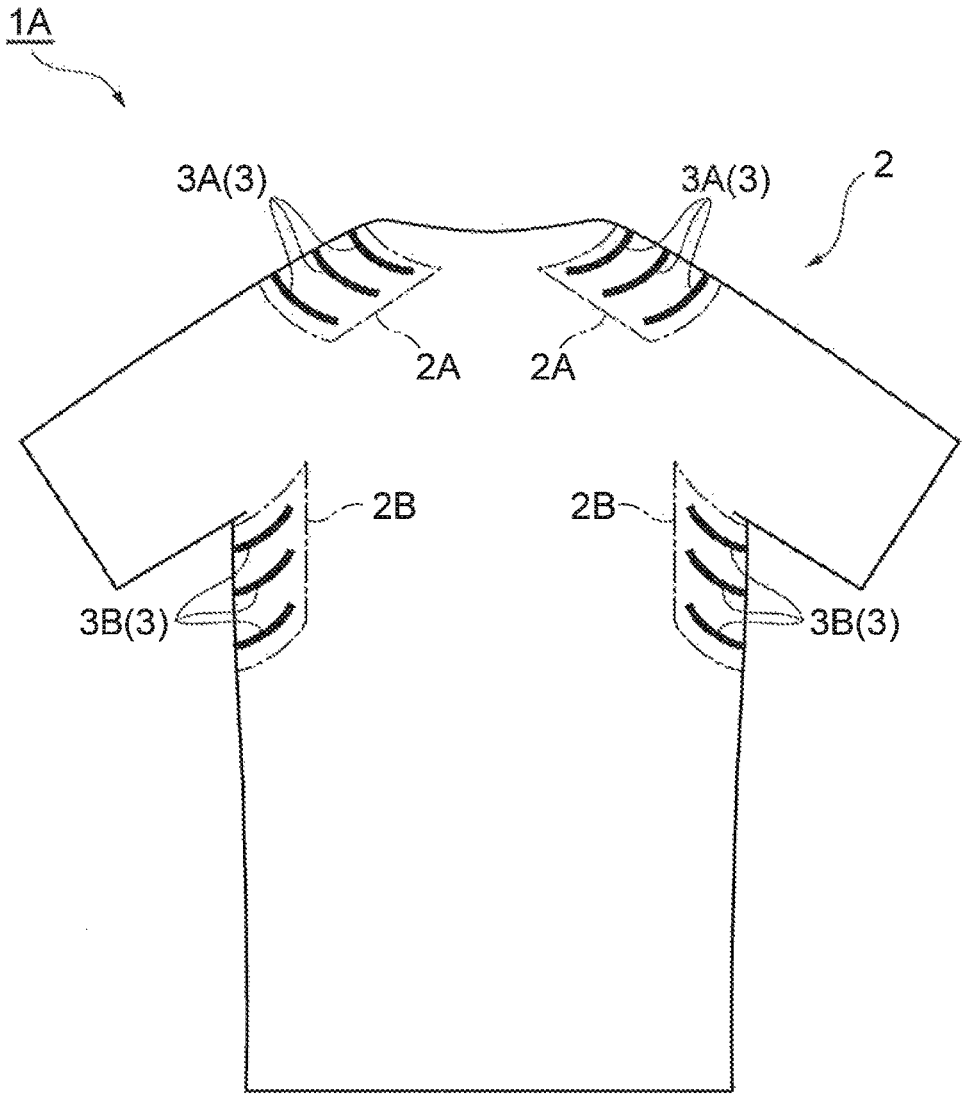
FIG. 2 is a rear view of the undershirt illustrated in FIG. 1.

FIG. 1 is a front view illustrating an undershirt which is the first embodiment of the garment in accordance with the present invention. FIG. 2 is a rear view of the undershirt illustrated in FIG. 1. The undershirt 1A illustrated in FIGS. 1 and 2 is a half-sleeve shirt worn for improving the athletic ability when playing various kinds of sports such as tennis, golf, baseball, and running, for example.

The undershirt 1A comprises a main part 2 formed such as to fit the upper half of the body of the wearer tightly and line parts 3 sewn to the front side of the main part 2. The body part 2 is constituted by a front body, a back body, a neck part, and sleeve parts, for example. These parts are sewn together along undepicted seam lines.

An elastic material is used for constructing the main part 2. As the elastic material, bare jersey formed by mixing yarns of polyester and polyurethane can be used, for example. Using such a material favorably brings the main part 2 fit the upper half of the body of the wearer tightly. The compression pressure in the main part 2 is preferably 1.5 kPa or less, more preferably 1 kPa or less, at the maximum pressure part, for example.

Each of the line parts 3 is formed like an arch by a material having a stretching force greater than that of the main part 2, for example. As the material having a stretching force greater than that of the main part 2, a power net formed by mixing yarns of nylon and polyurethane can be used, for example. In the main part 2, the line parts 3 are disposed in regions 2A, 2A corresponding to left and right shoulders of the wearer and regions 2B, 2B corresponding to left and right sides of the wearer.

For example, three line parts 3A are disposed in each of the regions 2A, 2A corresponding to the shoulders. The line parts 3A are arranged at predetermined intervals at respective positions between a shoulder joint and the neck. The mountain side (convex side) 3*a*' and valley side (concave side) 3*b*' of each line part 3A face the shoulder joint and neck, respectively. Therefore, in each line part 3A, the direction from the mountain side 3*a*' to valley side 3*b*' of the arch intersects a tension line extending in the front-back direction in the shoulder.

For example, the line parts 3A have a width of 0.5 cm each and respective lengths, sequentially from the line part 3A on the shoulder joint side, of 9.0 cm, 9.0 cm, and 9.0 cm before being worn and 9.8 cm, 9.8 cm, and 9.8 cm thereafter. For example, the line parts 3A have respective radii of curvature, sequentially from the line part 3A on the shoulder joint side, of 4.7 cm, 4.7 cm, and 4.7 cm before being worn and 10.9 cm, 10.9 cm, and 10.9 cm thereafter.

For example, three line parts 3B are disposed in each of the regions 2B, 2B corresponding to the sides as in the shoulders. The line parts 3B are arranged at predetermined intervals at respective positions directly under the underarm. In each line part 3B, the mountain and valley sides face the waist and the underarm, respectively. Therefore, in each line part 3B, the direction from the mountain side to valley side of the arch intersects a tension line extending about the torso at the side.

For example, the line parts 3B have a width of 0.5 cm each and respective lengths, sequentially from the line part 3B on the underarm side, of 9.0 cm, 9.0 cm, and 9.0 cm before being worn and 10.8 cm, 10.2 cm, and 9.8 cm thereafter. For example, the line parts 3B have respective radii of curvature, sequentially from the line part 3B on the underarm side, of 4.7 cm, 4.7 cm, and 4.7 cm before being worn and 16.0 cm, 13.0 cm, and 10.9 cm thereafter.

Operations and effects of the undershirt 1A having the structure mentioned above will now be explained.

Figure 3:
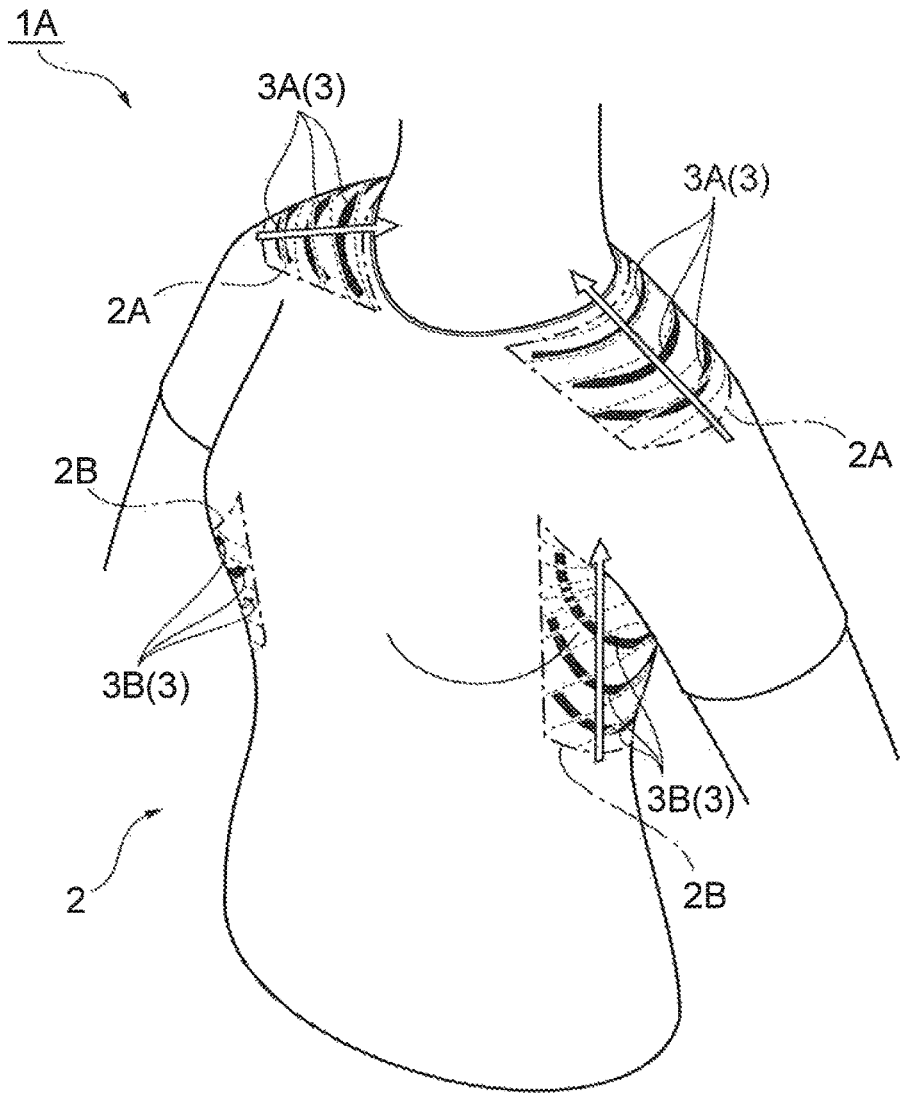
FIG. 3 is a diagram illustrating a state of wearing the undershirt depicted in FIGS. 1 and 2.

FIG. 3 is a diagram illustrating a state of wearing the undershirt 1A. When the undershirt 1A is worn, as depicted, the main part 2 fit the body of the wearer tightly, and each of the arch-shaped line parts 3 exhibits a greater radius of curvature than therebefore. Here, each line part 3 is formed by a material having a stretching force greater than that of the main part 2. Therefore, a force to restore the line part 3 to its original form acts on the skin of the wearer, thereby moving the skin of the wearer in the direction from the mountain side to valley side of the line part 3.

Each of the line parts 3A in the regions 2A, 2A corresponding to the shoulders, in which the direction from the mountain side to valley side of the arch intersects the tension line extending in the front-back direction in the shoulder, acts to extend the skin on the shoulder of the wearer toward the neck. In the shoulder, the skin at a location where a wrinkle is formed when the wearer abducts the shoulder joint tends to leave the joint, and this movement is in the same direction as with an original skin movement. Therefore, moving the skin toward the neck with each line part 3A can promote the original skin movement at the time when the wearer abducts the shoulder joint, thereby making it possible to widen the range of motion of the joint and smoothen the motion.

Each of the line parts 3B in the regions 2B, 2B corresponding to the sides, in which the direction from the mountain side to valley side of the arch intersects the tension line extending about the torso at the side, acts to gather the skin of the wearer at the side. In the side, the skin at a location to extend when the wearer abducts the shoulder joint tends to gather at the joint, and this movement is in the same direction as with an original skin movement. Therefore, moving the skin toward the side with each line part 3B can promote the original skin movement at the time when the wearer abducts the shoulder joint, thereby making it possible to widen the range of motion of the joint and smoothen the motion.

Because of the foregoing, the undershirt 1A can widen the ranges of motions of shoulder joint abductions of the wearer and smoothen abduction motions, thereby improving the athletic ability of the wearer.

Second Embodiment

Figure 4:
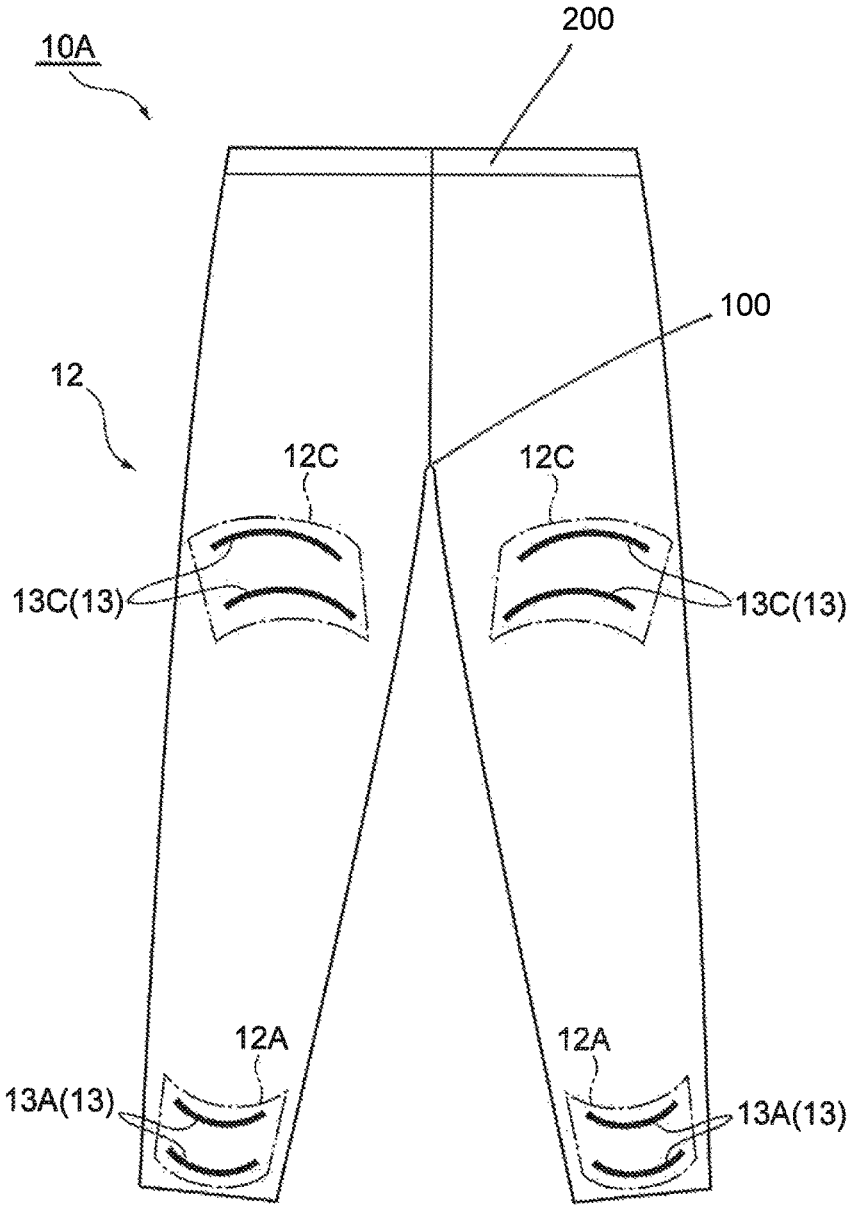
FIG. 4 is a front view of leggings which are a second embodiment of the garment in accordance with the present invention.
Figure 5:
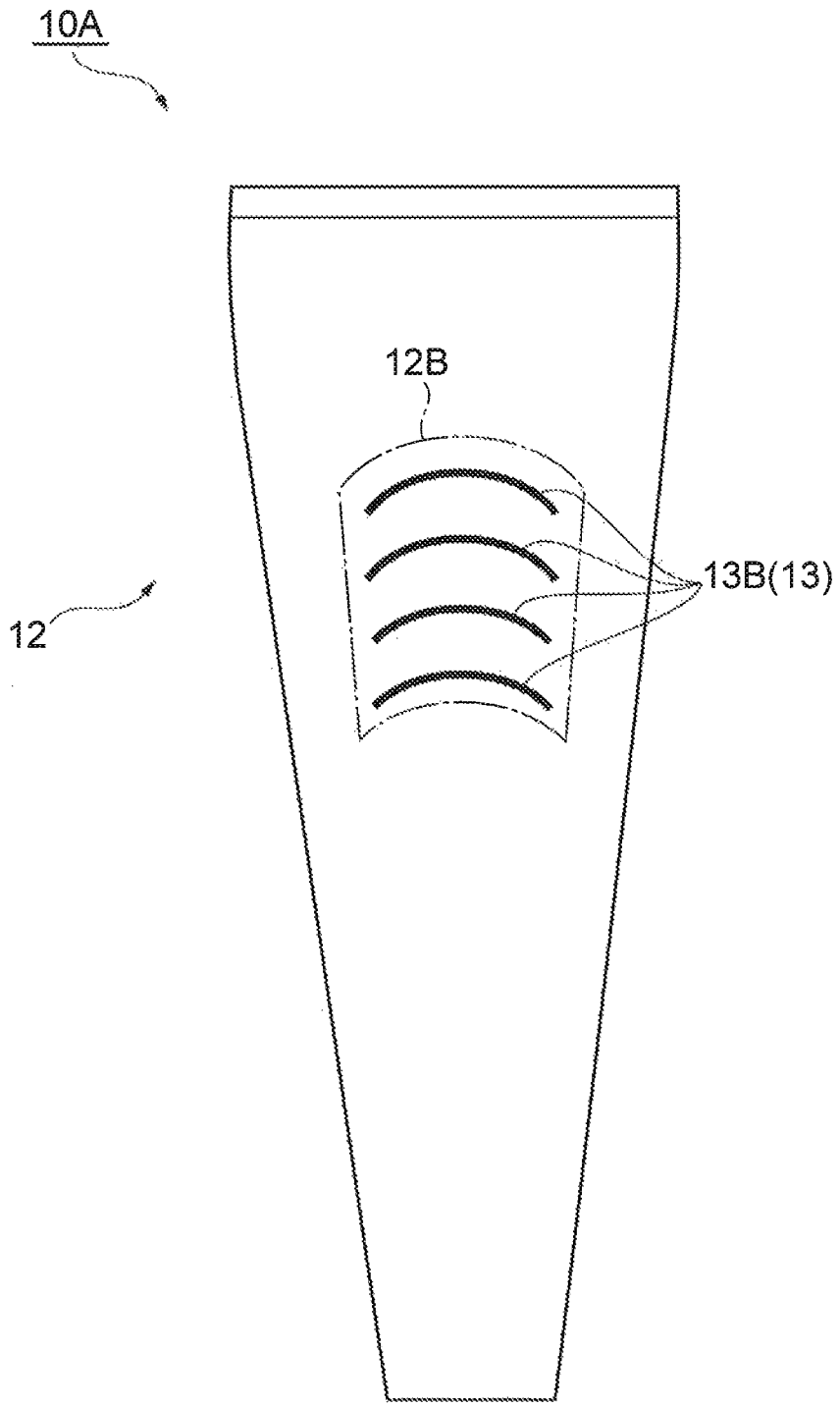
FIG. 5 is a side view of the leggings depicted in FIG. 4.

FIG. 4 is a front view illustrating leggings which are the second embodiment of the garment in accordance with the present invention. FIG. 5 is a side view of FIG. 4. As illustrated in FIGS. 4 and 5, the leggings 10A are ankle-length leggings worn for improving the athletic ability when playing various kinds of sports such as tennis, golf, baseball, and running, for example. The leggings 10A comprise a main part 12 formed such as to fit the lower half of the body of the wearer tightly and line parts 13 sewn to the front side of the main part 12.

Left and right parts of the main part 12 are sewn together by a seam line traveling the crotch part 100 in the front-back direction. For example, a rubber-inserted inside tape is passed through a waist part 200 of the main part 12, so as to secure a feel of fitness at the waist part 200 upon wearing. An elastic material is used for constructing the main part 12. As the elastic material, two-way tricot formed by mixing yarns of polyester and polyurethane can be used, for example. Using such a material favorably brings the main part 2 fit the lower half of the body of the wearer tightly. The compression pressure in the main part 12 is preferably 1 kPa or less, for example.

Each of the line parts 13 is formed like an arch by a material having a stretching force greater than that of the main part 12. As the material having a stretching force greater than that of the main part 12, a power net formed by mixing yarns of nylon and polyurethane can be used, for example. In the main part 12, the line parts 13 are disposed in regions 12A, 12A corresponding to left and right ankles, regions 12B, 12B corresponding to the crotch, and regions 12C, 12C corresponding to left and right thighs of the wearer.

For example, two line parts 13A are disposed in each of the regions 12A, 12A corresponding to the ankles as illustrated in FIG. 4. The line parts 13A are arranged at a predetermined interval at respective positions on the front side of the ankles. The mountain and valley sides of each line part 13A face the ankle and knee, respectively. Therefore, in each line part 13A, the direction from the mountain side to valley side of the arch intersects a tension line extending about the ankle.

For example, the line parts 13A have a width of 0.5 cm each and respective lengths, sequentially from the line part 13A on the foot side, of 8.6 cm and 10.0 cm before being worn and 10.2 cm and 12.0 cm thereafter. For example, the line parts 13A have respective radii of curvature, sequentially from the line part 13A on the foot side, of 6.1 cm and 6.1 cm before being worn and 12.5 cm and 11.8 cm thereafter.

For example, four line parts 13B are disposed in each of the regions 12B, 12B corresponding to the crotch as illustrated in FIG. 5. The line parts 13B are arranged at predetermined intervals at respective positions near a greater trochanter. The mountain and valley sides of each line part 13B face the waist and knee, respectively. Therefore, in each line part 13B, the direction from the mountain side to valley side of the arch intersects a tension line extending about the leg at the crotch.

For example, the line parts 13B have a width of 0.5 cm each and respective lengths, sequentially from the line part 13B on the knee side, of 11.6 cm, 11.6 cm, 11.6 cm, and 11.6 cm before being worn and 14 cm, 14 cm, 12.5 cm, and 12.5 cm thereafter. For example, the line parts 13B have respective radii of curvature, sequentially from the line part 13B on the knee side, of 7.7 cm, 7.7 cm, 7.7 cm, and 7.7 cm before being worn and 10.8 cm, 10.8 cm, 9.3 cm, and 9.3 cm thereafter.

For example, two line parts 13C are disposed in each of the regions 12C, 12C corresponding to the thighs as illustrated in FIG. 4. The line parts 13C are arranged at a predetermined interval at respective positions on the front side of the thighs. The mountain and valley sides of each line part 13C face the crotch and knee, respectively. Therefore, in each line part 13C, the direction from the mountain side to valley side of the arch intersects a tension line extending obliquely from the upper outer side to lower inner side in the thigh. The line parts 13C are located at positions where femoral muscles bulge when hip joints turn inward.

For example, the line parts 13C have a width of 0.5 cm each and respective lengths, sequentially from the line part 13C on the knee side, of 11.0 cm and 11.0 cm before being worn and 14.0 cm and 12.0 cm thereafter. For example, the line parts 13C have respective radii of curvature, sequentially from the line part 13C on the knee side, of 9.1 cm and 9.1 cm before being worn and 14.7 cm and 11.5 cm thereafter.

Operations and effects of the leggings 10A having the structure mentioned above will now be explained.

Figure 6:
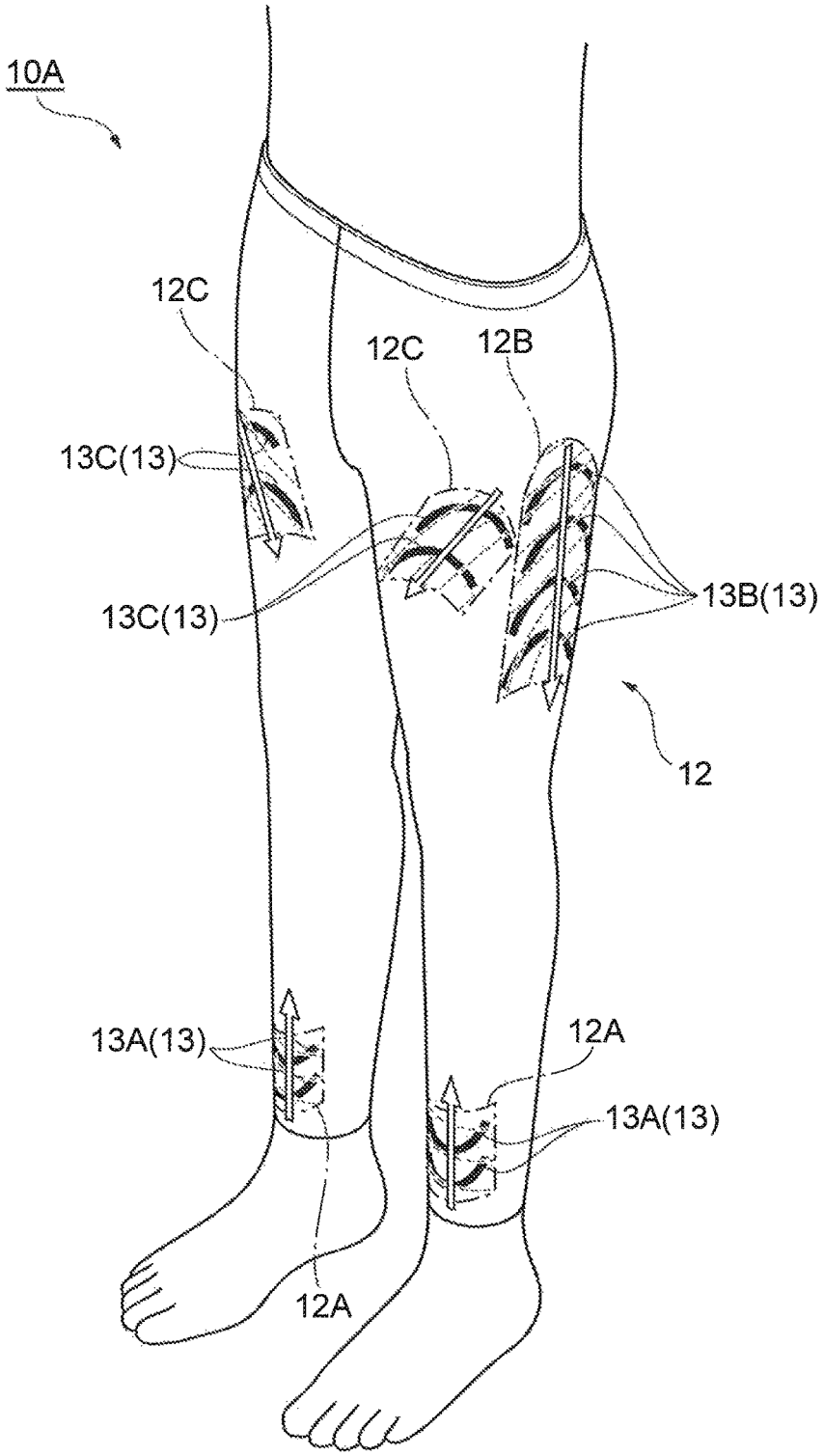
FIG. 6 is a diagram illustrating a state of wearing the leggings depicted in FIGS. 4 and 5.

FIG. 6 is a diagram illustrating a state of wearing the leggings 10A. When the leggings 10A are worn, as depicted, the main part 12 fit the body of the wearer tightly, and each of the arch-shaped line parts 13 exhibits a greater radius of curvature than therebefore. Here, each line part 13 is formed by a material having a stretching force greater than that of the main, part 12. Therefore, a force to restore the line part 13 to its original form acts on the skin of the wearer, thereby moving the skin of the wearer in the direction from the mountain side to valley side of the line part 13.

Each of the line parts 13A in the regions 12A, 12A corresponding to the ankles, in which the direction from the mountain side to valley side of the arch intersects the tension line extending about the ankle, acts to move the skin in the ankle of the wearer toward the knee. In the ankle, the skin at a location where a wrinkle is formed when the wearer extends an ankle joint tends to leave the joint, and this movement is in the same direction as with an original skin movement. Therefore, moving the skin toward the knee with each line part 13A can promote the original skin movement at the time when the wearer extends the ankle, thereby making it possible to widen the range of motion of the joint and smoothen the motion.

Each of the line parts 13B in the regions 12B, 12B corresponding to lower parts of the greater trochanters, in which the direction from the mountain side to valley side of the arch intersects the tension line extending about the leg in the lower part of the greater trochanter, acts to extend the skin in the lower part of the greater trochanter of the wearer toward the knee. In this part, the skin at a location where a wrinkle is formed when the wearer abducts the hip joint tends to leave the joint, and this movement is in the same direction as with an original skin movement. Therefore, moving the skin toward the knee with each line part 13B can promote the original skin movement at the time when the wearer abducts the lower part of the greater trochanter, thereby making it possible to widen the range of motion of the joint and smoothen the motion.

Each of the line parts 13C in the regions 12C, 12C corresponding to the thighs, in which the direction from the mountain side to valley side of the arch intersects the tension line extending obliquely from the upper outer side to lower inner side in the thigh, acts to move the skin on the front side of the thigh of the wearer to the inner side of the thigh. The skin in this part tends to move along the tension line when the wearer inwardly turns the hip joint, and this movement is in the same direction as with an original skin movement. Therefore, moving the skin from the upper outer side to lower inner side of the thigh in conformity to the direction of inward turning can promote the original skin movement at the time when the wearer inwardly turns the hip joint, thereby making it possible to widen the range of motion of the joint and smoothen the motion.

Because of the foregoing, the leggings 10A can widen the ranges of motions of ankle and hip joints of the wearer and smoothen the extension of the ankle joints and the abduction and inward turning of the hip joints, thereby improving the athletic ability of the wearer.

In the leggings 10A, the line parts 13C are arranged at positions where femoral muscles bulge when hip joints turn inward. This allows the bulges of the femoral muscles to further enhance the radii of curvature of the line parts 13C when the wearer turns the hip joints inward, which increases the stretching force of the line parts 13C, whereby the skin of the wearer can securely be moved to the inner side of the thighs.

Third Embodiment

Figure 7:
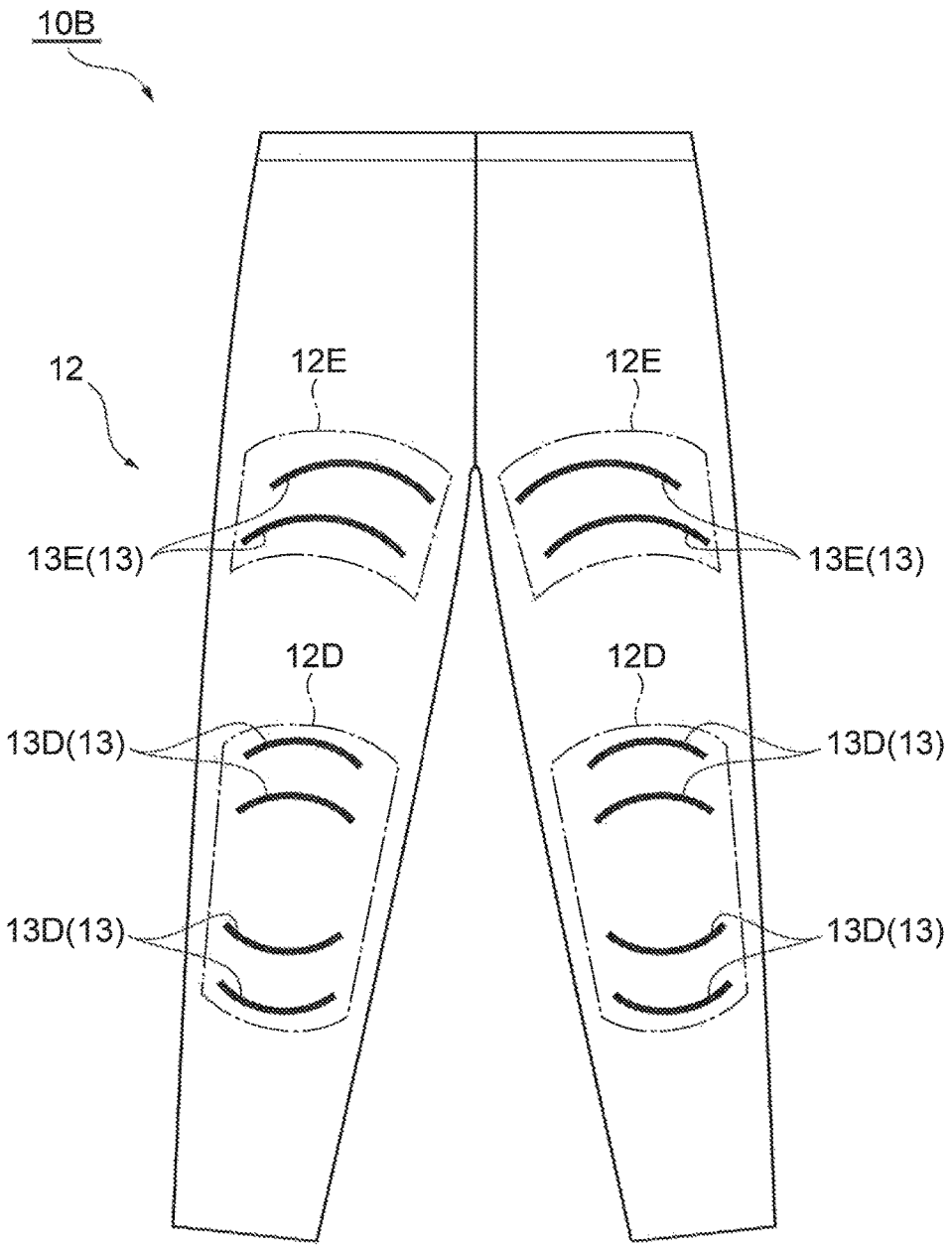
FIG. 7 is a front view illustrating leggings which are a third embodiment of the garment in accordance with the present invention.
Figure 8:
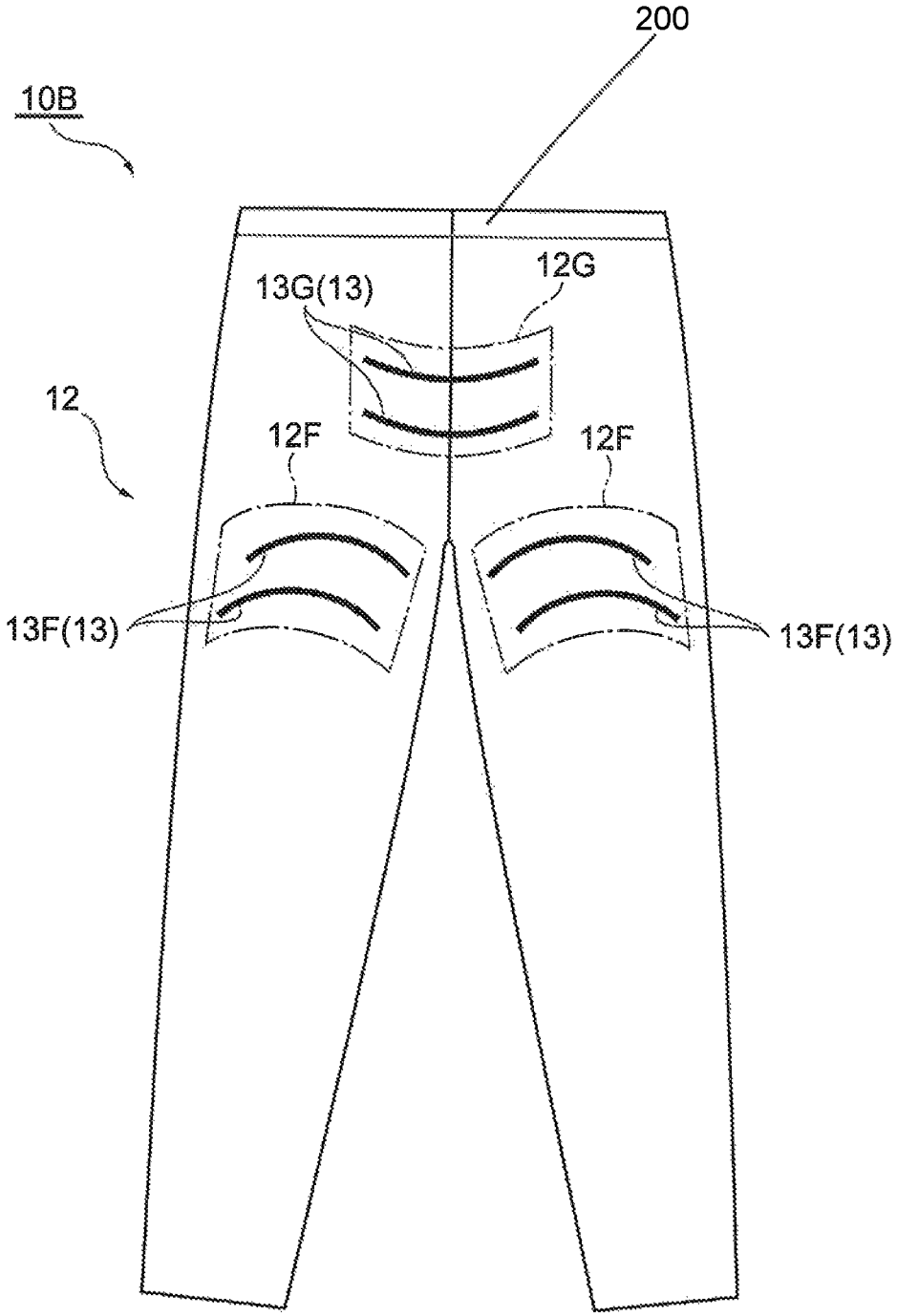
FIG. 8 is a rear view of the leggings illustrated in FIG. 7.

FIG. 7 is a front view illustrating leggings which are the third embodiment of the garment in accordance with the present invention. FIG. 8 is a rear view of FIG. 7. As in the second embodiment, the leggings 10B illustrated in FIGS. 7 and 8 are ankle-length leggings worn for improving the athletic ability when playing various kinds of sports such as tennis, golf, baseball, and running, for example.

The leggings 10B are the same as those of the second embodiment except for the arrangement of the line parts 13. That is, in the leggings 10B, the line parts 13 are disposed in regions 12D, 12D corresponding to left and right knees, regions 12E, 12E corresponding to left and right groins, regions 12F, 12F corresponding to left and right hips, and a region 12G corresponding to the center of the hips of the wearer in the main part 12.

In the regions 12D, 12D corresponding to the knees, two line parts 13D, 13D are disposed on each of the upper and lower sides of a knee joint as illustrated in FIG. 7. The lines 13D are arranged at a predetermined interval at respective positions on the front side of the knees. The mountain and valley sides of each line part 13D on the upper side of the knee face the crotch and knee, respectively. Therefore, the direction from the mountain side to valley side of the arch intersects a tension line extending about the leg at the knee. On the other hand, the mountain and valley sides of each line part 13E on the lower side of the knee face the ankle and knee, respectively. As a consequence, the direction from the mountain side to valley side of the arch in each line part 13D intersects the tension line extending about the leg at the knee.

For example, the line parts 13D on the upper side of the knee have a width of 0.5 cm each and respective lengths, sequentially from the line part 13D on the knee side, of 12.2 cm and 12.8 cm before being worn and 13.7 cm and 14.0 cm thereafter. For example, the line parts 13D on the upper side of the knee have respective radii of curvature, sequentially from the line part 13D on the knee side, of 8.6 cm and 12.4 cm before being worn and 15.6 cm and 45.8 cm thereafter. For example, the line parts 13D on the lower side of the knee have a width of 0.5 cm each and respective lengths, sequentially from the line part 13D on the knee side, of 12.8 cm and 12.2 cm before being worn and 13.0 cm and 12.5 cm thereafter. For example, the line parts 13C on the lower side of the knee have respective radii of curvature, sequentially from the line part 13D on the knee side, of 12.4 cm and 8.6 cm before being worn and 16.9 cm and 11.1 cm thereafter.

For example, two line parts 13E are disposed in the regions 12E, 12E corresponding to the left and right groins. The lines 13E are arranged at a predetermined interval at respective positions on the lower side of the groins. The mountain and valley sides of each line part 13E face the groin and knee, respectively. As a consequence, the direction from the mountain side to valley side of the arch in each line part 13E intersects a tension line extending along the groin.

For example, the line parts 13E have a width of 0.5 cm each and respective lengths, sequentially from the line part 13E on the knee side, of 11.2 cm and 11.7 cm before being worn and 13.5 cm and 13.0 cm thereafter. For example, the line parts 13E have respective radii of curvature, sequentially from the line part 13E on the knee side, of 7.3 cm and 7.9 cm before being worn and 10.9 cm and 12.5 cm thereafter.

For example, two line parts 13F are disposed in each of the regions 12F, 12F corresponding to the left and right hips as illustrated in FIG. 8. The line parts 13F are arranged at a predetermined interval at respective positions on the lower side of a gluteal fold. The mountain and valley sides of each line part 13F face the gluteal fold and knee, respectively. As a consequence, the direction from the mountain side to valley side of the arch in each line part 13F intersects a tension line extending along the gluteal fold on the lower side of the gluteal fold.

For example, the line parts 13F have a width of 0.5 cm each and respective lengths, sequentially from the line part 13F on the knee side, of 11.0 cm and 11.0 cm before being worn and 12.5 cm and 12.8 cm thereafter. For example, the line parts 13F have respective radii of curvature, sequentially from the line part 13F on the knee side, of 8.2 cm and 82 cm before being worn and 14.9 cm and 12.3 cm thereafter.

For example, two line parts 13G are disposed in the region 12G, 12G corresponding to the center of the hips as illustrated in FIG. 8. The line parts 13G are arranged at a predetermined interval at respective positions on the upper side of gluteal folds. The mountain and valley sides of each line part 13G face the gluteal fold and waist part 200, respectively. As a consequence, the direction from the mountain side to valley side of the arch in each line part 13G intersects a tension line extending along the gluteal folds on the upper side of the gluteal folds.

Figure 9:
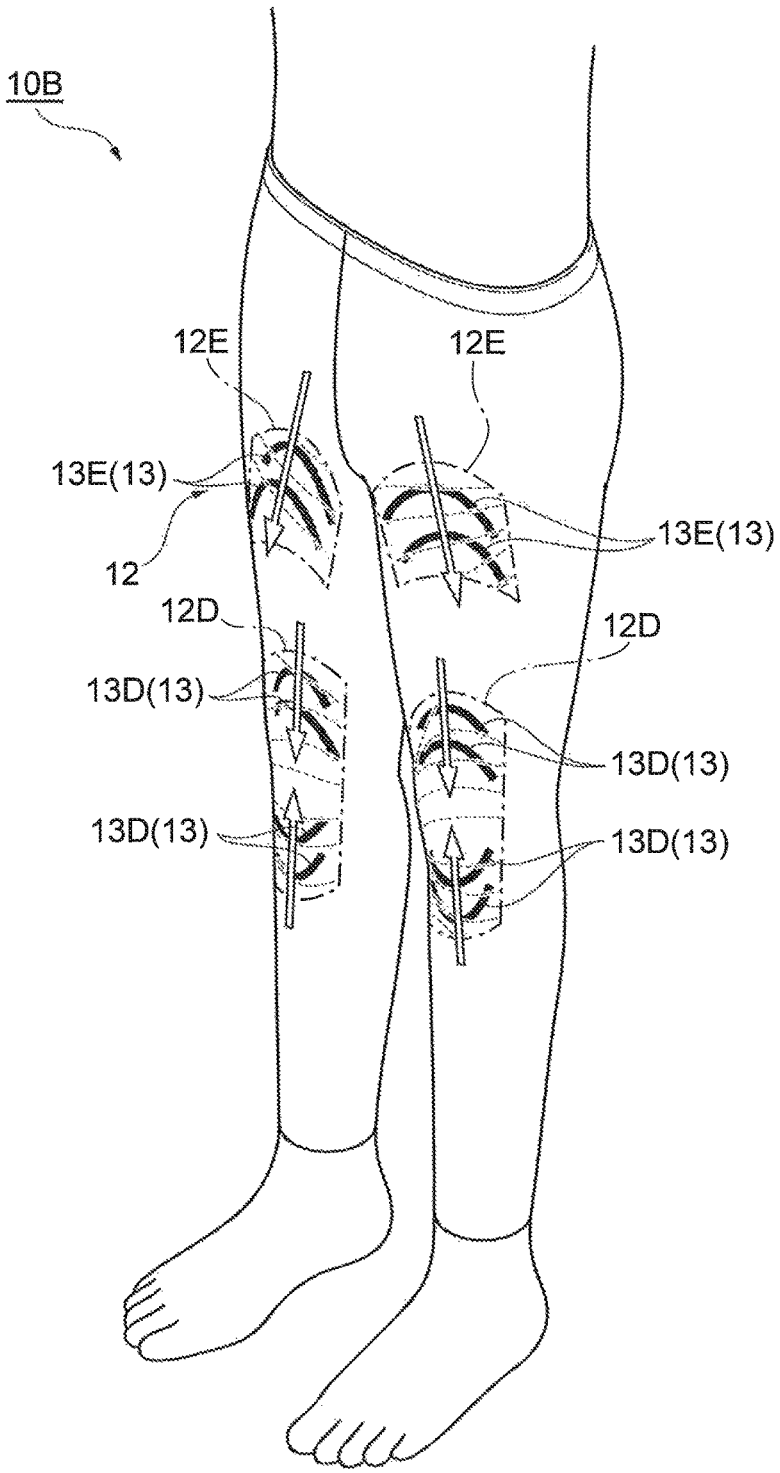
FIG. 9 is a diagram illustrating a state of wearing the leggings depicted in FIGS. 7 and 8 as seen from the front side.
Figure 10:
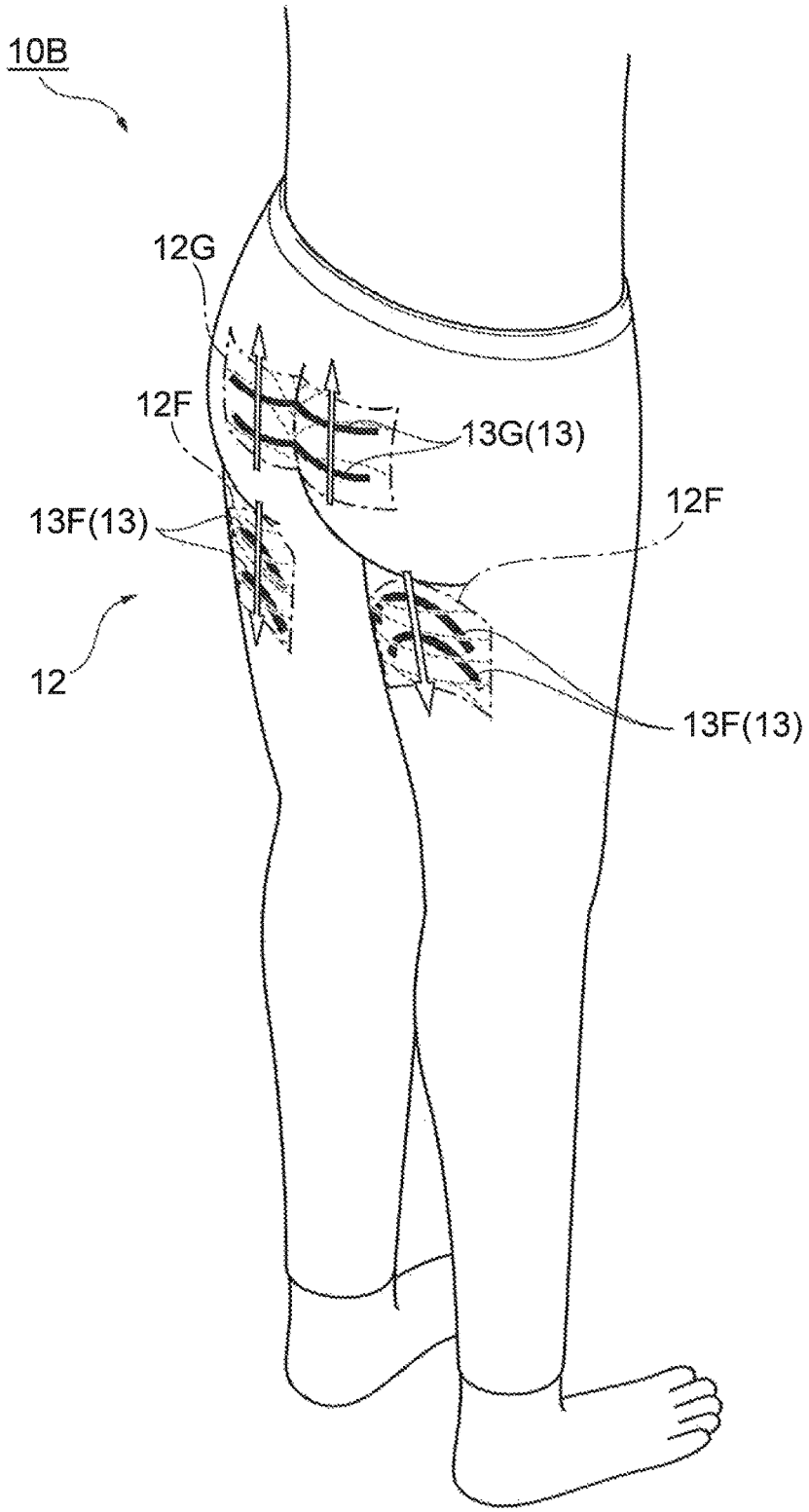
FIG. 10 is a diagram illustrating the state of wearing the leggings depicted in FIGS. 7 and 8 as seen from the rear side.

When such leggings 10B are worn, as illustrated in FIGS. 9 and 10, the main part 12 fit the body of the wearer tightly, and each of the arch-shaped line parts 13 exhibits a greater radius of curvature than therebefore. Here, each line part 13 is formed by a material having a stretching force greater than that of the main part 12. Therefore, a force to restore the line part 13 to its original form acts on the skin of the wearer, thereby moving the skin of the wearer in the direction from the mountain side to valley side of the line part 13.

Each of the line parts 13D in the regions 12D, 12D corresponding to the knees, in which the direction from the mountain side to valley side of the arch intersects the tension line extending about the leg at the knee, acts to gather the skin on the front side of the knee of the wearer at the knee side. In the knee, the skin at a location to extend when the wearer bends the knee joint tends to gather at the joint, and this movement is in the same direction as with an original skin movement. Therefore, moving the skin in this part toward the knee with each line part 13D can promote the original skin movement at the time when the wearer bends the knee, thereby making it possible to widen the range of motion of the joint and smoothen the motion.

Each of the line parts 13E in the regions 12E, 12E corresponding to the knees, in which the direction from the mountain side to valley side of the arch intersects the tension line extending along the groin, acts to extend the skin in the groin of the wearer toward the knee. In the groin, the skin at a location where a wrinkle is formed when the wearer bends the hip joint tends to leave the joint, and this movement is in the same direction as with an original skin movement. Therefore, moving the skin in this part toward the knee with each line part 13E can promote the original skin movement at the time when the wearer bends the hip joint, thereby making it possible to widen the range of motion of the joint and smoothen the motion.

Each of the line parts 13F in the regions 12F, 12F corresponding to the left and right hips, in which the direction from the mountain side to valley side of the arch intersects the tension line extending along the gluteal fold on the lower side of the gluteal fold, acts to extend the skin on the lower side of the gluteal fold of the wearer toward the knee. On the lower side of the gluteal fold, the skin at a location where a wrinkle is formed when the wearer extends the hip joint tends to leave the joint, and this movement is in the same direction as with an original skin movement. Therefore, moving the skin in this part toward the knee with each line part 13F can promote the original skin movement at the time when the wearer extends the hip joint, thereby making it possible to widen the range of motion of the joint and smoothen the motion.

Each of the line parts 13G in the region 12G corresponding to the center of the hips, in which the direction from the mountain side to valley side of the arch intersects the tension line extending along the gluteal folds on the upper side of the gluteal folds, acts to extend the skin on the lower side of the gluteal fold of the wearer toward the waist. On the upper side of the gluteal folds, the skin at a location where a wrinkle is formed when the wearer extends the hip joint or trunk tends to leave the joint, and this movement is in the same direction as with an original skin movement. Therefore, moving the skin in this part toward the waist with each line part 13G can promote the original skin movement at the time when the wearer extends the hip joint or trunk, thereby making it possible to widen the range of motion of the joint and smoothen the motion.

Because of the foregoing, the leggings 10B can widen the ranges of motions of knee and hip joints of the wearer and smoothen the bending of the knee joints, the bending/extension of the hip joints, and the extension of the trunk, thereby improving the athletic ability of the wearer.

The present invention is not limited to the above-mentioned embodiments. For example, while the above-mentioned embodiments illustrate the undershirt and leggings as examples of garments to which the line parts 3, 13 are applied, they are also applicable to various garments such as pants, girdles, tights, and stockings.

Figure 11:
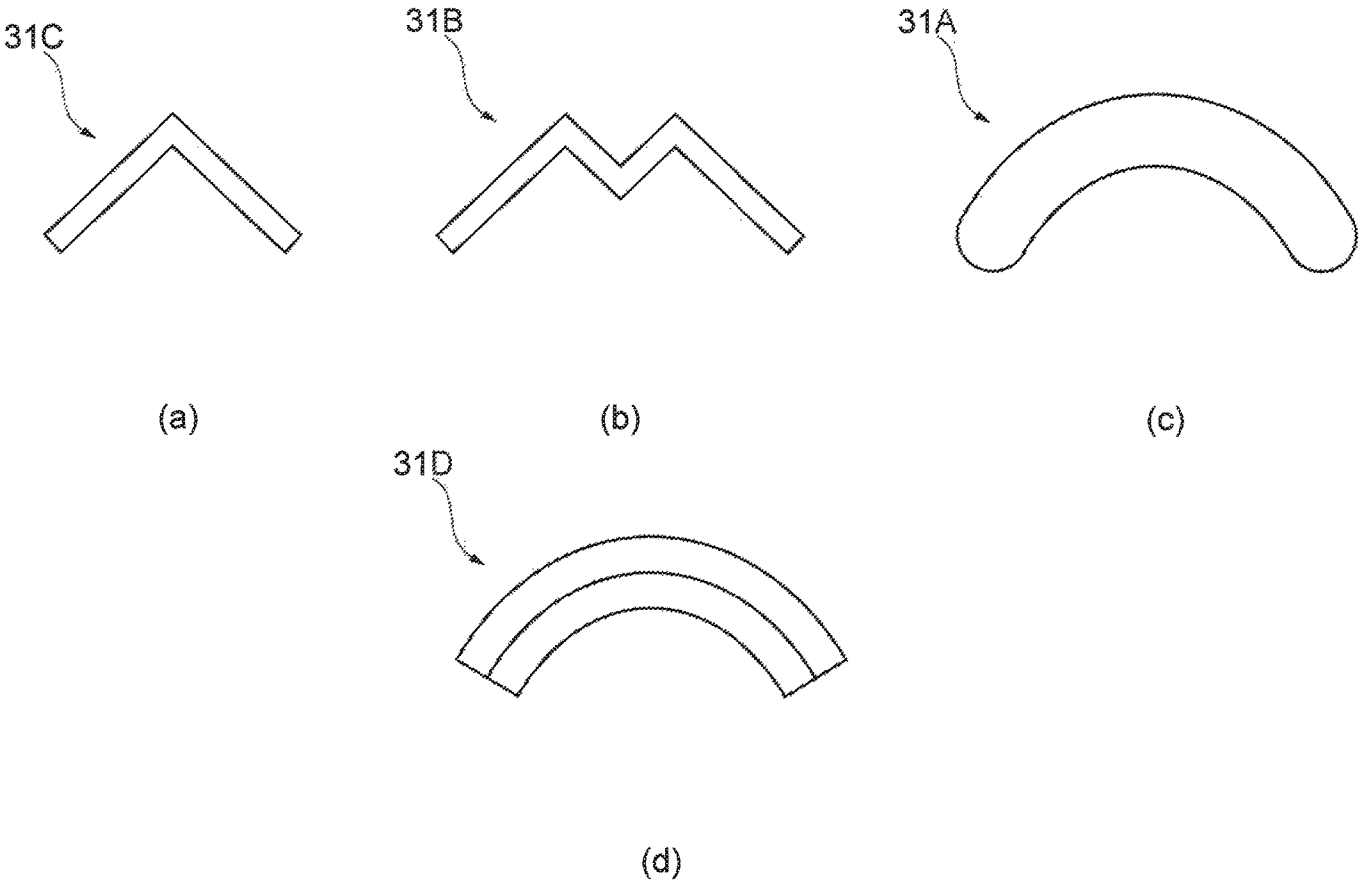
FIG. 11 is a set of diagrams illustrating modified examples of a line part.
Figure 12:
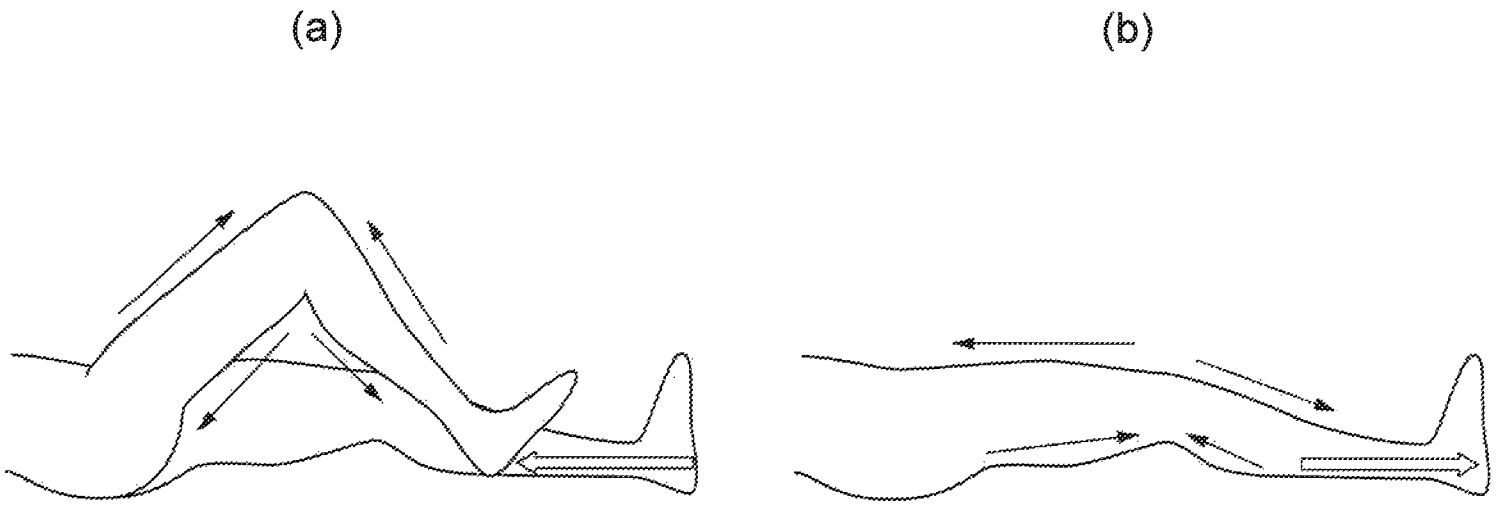
FIG. 12 is a set of diagrams illustrating relationships between bending/extending motions of a knee joint and movements of the skin.
Figure 13:
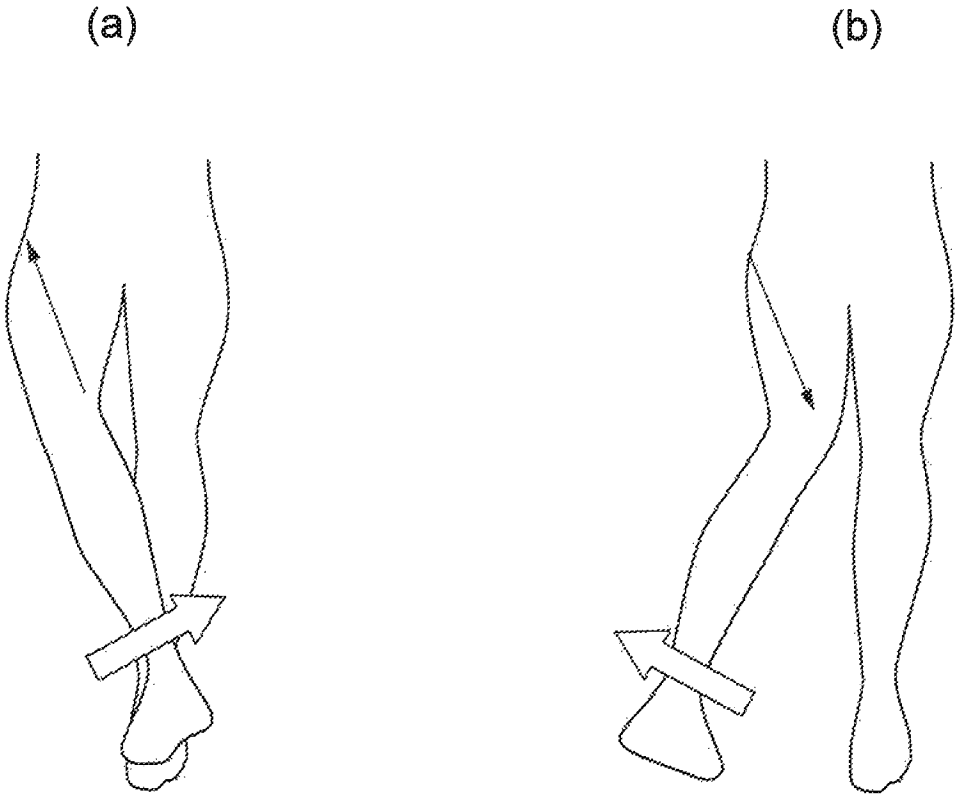
FIG. 13 is a set of diagrams illustrating relationships between outward/inward motions of a hip joint and movements of the skin.

The number by which the line parts are arranged, their forms, and the like may be changed as appropriate depending on the size and kind of the garment, the target gender, and the like. The arch-shaped line part is not limited to the arc one in the above-mentioned embodiments, but may be a V-shaped line part 31A as illustrated in FIG. 11(*a*) or a W-shaped line part 31B which has a center not projecting from both ends and forms an arch as a whole as illustrated in FIG. 11(*b*). It may also be a rounded line part 31C forming an arch as a whole as illustrated in FIG. 11(*c*). The line parts are not limited to patches as in the embodiments. The line parts may also be formed by changing knitting structures, printing with resins, or opal finishing, for example.

As illustrated in FIG. 11(*d*), a line part 31D having a greater stretching force on the valley side of the arch than on the mountain side thereof may be employed. When arranging a plurality of line parts in a given region along the direction from the mountain side to valley side of the arch, the line part located on the valley side may have a stretching force greater than that of the line part located on the mountain side. Such a structure makes it possible for the line parts to act on the skin more reliably.

Preferably, in each of the above-mentioned embodiments, the longitudinal direction of the material constituting the main part 2, 12 (the direction exhibiting the greater stretching force) coincides with the direction in which the line parts 3, 13 move the skin. Preferably, the longitudinal direction of the material constituting the line parts 3, 13 coincides with the longitudinal direction at the time of wearing.

REFERENCE SIGNS LIST

1A . . . undershirt (garment); 2 . . . main part; 2A . . . region corresponding to a shoulder; 2B . . . region corresponding to a side; 3 (3A, 3B) . . . line part; 10A, 10B . . . leggings (garment); 12 . . . main part; 12A . . . region corresponding to an ankle; 12B . . . region corresponding to a crotch; 12C . . . region corresponding to a thigh; 12D . . . region corresponding to a knee; 12E . . . region corresponding to a groin; 12F . . . region corresponding to a left or right hip; 12G . . . region corresponding to a center of the hips; 13 (13A to 13G) . . . line part; 31A to 31D . . . line part

The invention claimed is:

1. A garment comprising:

a main part formed by a material having elasticity, said material of the main part adapted to tightly fit a wearer's body, including a pair of buttocks of the wearer's body, the main part including a waist part and a crotch part; and a plurality of arch-shaped line parts, wherein each arch-shaped line part has at a first end and a second end, and an entire length of each arch-shaped line part being between said first end and said second end, wherein each arch-shaped line part is disposed between the waist part and the crotch part, each arch-shaped line part being parallel to another arch-shaped line part of the plurality of arch-shaped line parts along the entire length of each arch-shaped line part, each arch-shaped line part adapted to have a stretching force greater than a stretching force of the main part and exhibiting a greater radius of curvature when the garment is worn than when the garment is not worn, each arch-shaped line part having a convex side and a concave side; and, wherein each arch-shaped line part is a knit structure, a resin print, or an opal finish, and each arch-shaped line part is adapted to be disposed in a region corresponding to a center of the pair of buttocks, wherein the concave side faces the waist part and the convex side faces the crotch part;

wherein the garment has an unworn configuration and a worn configuration, wherein in the unworn configuration, the entire length of each arch-shaped line part is a first value and each arch-shaped line part has a first radius of curvature, and in the worn configuration, the entire length of each arch-shaped line part is a second value and each arch-shaped line part has a second radius of curvature, wherein the second value is greater than the first value and the second radius of curvature is greater than the first radius of curvature.

2. A garment according to claim 1, wherein each arch-shaped line part comprises a mixture of yarns such that there is a greater stretching force on the concave side than the convex side thereof.

3. The garment according to claim 1, wherein each first end is adapted to be disposed at a first buttock of the pair of buttocks, and each second end is adapted to be disposed at a second buttock of the pair of buttocks.

* * * * *